US006066223A

United States Patent [19]

Gomes et al.

[11] Patent Number: 6,066,223

[45] Date of Patent: May 23, 2000

[54] LABELING MACHINE AND METHOD

[75] Inventors: Gary G. Gomes, Winton; Joseph C. Parker, Turlock; Svatoboj Otruba, Ceres, all of Calif.

[73] Assignee: B & H Manufacturing Company, Inc., Ceres, Calif.

[21] Appl. No.: 08/678,393

[22] Filed: Jul. 2, 1996

[51] Int. Cl.[7] ..... B65C 3/16; B65C 9/04

[52] U.S. Cl. ..... 156/215; 156/449; 156/DIG. 13; 156/DIG. 26

[58] Field of Search ..... 156/86, 446, 448, 156/449, 456, 215, DIG. 11, DIG. 13, DIG. 26, DIG. 31, 568, 447, 521, DIG. 10, DIG. 12, DIG. 33, DIG. 39; 271/275, 276

[56] References Cited

U.S. PATENT DOCUMENTS 4,574,020 3/1986 Fosnaught .
4,602,977 7/1986 Voltmer et al. ..... 271/276 X
4,662,965 5/1987 DiFrank et al. .
4,724,036 2/1988 Hill et al. .
4,923,557 5/1990 Dickey ..... 156/456 X
5,160,570 11/1992 Dickey .
5,403,416 4/1995 Bright et al. .

*Primary Examiner*—Curtis Mayes
*Attorney, Agent, or Firm*—Brooks & Kushman P.C.

[57] ABSTRACT

Labels or other segments or sheet material are wrapped around containers or other articles and adhered thereto by adhesive at the ends of the label. At each end pressure is applied by a vacuum drum acting on the end of the label to adhere it to the container. In between the container is caused to spin end is moved about the axis of the vacuum drum by direct contact of the drum with the container.

3 Claims, 2 Drawing Sheets

LABELING MACHINE AND METHOD

BACKGROUND OF THE INVENTION

This invention relates to a labeling machine for labeling containers. The terms "label" and "container" are used herein with the understanding that the invention is applicable to the application of segments of sheet or film material generally to articles other than containers, e.g. for decorative purposes.

In the labeling of containers, e.g. as described in U.S. Pat. No. 4,500,386, it is common practice to draw a continuous length of label material from a roll of the same, to cut it into suitable lengths so as to form individual labels and to deposit each label on the cylindrical surface of a rotating vacuum drum. By cylindrical as used herein is meant the shape of a right circular cylinder. Each label is held in place on the surface of the vacuum drum by vacuum, adhesive is applied to each end of the label while it is on the vacuum drum and the label with adhesive so applied is advanced to a labeling station at which it meets a container. Thereafter the container with a label attached to it is caused to spin and wrap the label about itself. The label may be wrapped around the entire circumference of the container with its trailing end lapped over and adhesively secured to its leading end, or it may be applied to only a portion of the container, both ends being adhered directly to the container.

In such operations the drive for the container which causes it to spin is friction between the vacuum drum and the label and between the label and the container. This is disadvantageous because friction between the label and the drum and between the label and the container is variable and/or the label may not provide a sufficient friction to rotate the container at the proper speed.

OBJECTS OF THE INVENTION

It is an object of the invention to provide an improved method of labeling containers.

It is a further object of the invention to provide an improved vacuum drum for labeling operations.

It is a particular object of the invention to avoid or greatly diminish the disadvantage resulting from reliance upon friction between label and the vacuum drum and between the label and the container.

Other objects will be apparent from the ensuing description and the appended claims.

SUMMARY OF THE INVENTIONS

In accordance with the invention, the label on a rotating vacuum drum is interposed between the surface of the vacuum drum and the container only at the beginning and at the end of labeling in order to press the ends of the label (which have adhesive applied to them), firmly against the container to adhere it to the container. Between these points the container is contacted directly by the vacuum drum and not through the medium of the label. It will be understood that adhesive may be applied to the container as in U.S. Pat. No. 3,834,963.

DETAILED DESCRIPTION OF THE INVENTION

Figures 1, 2, 3:
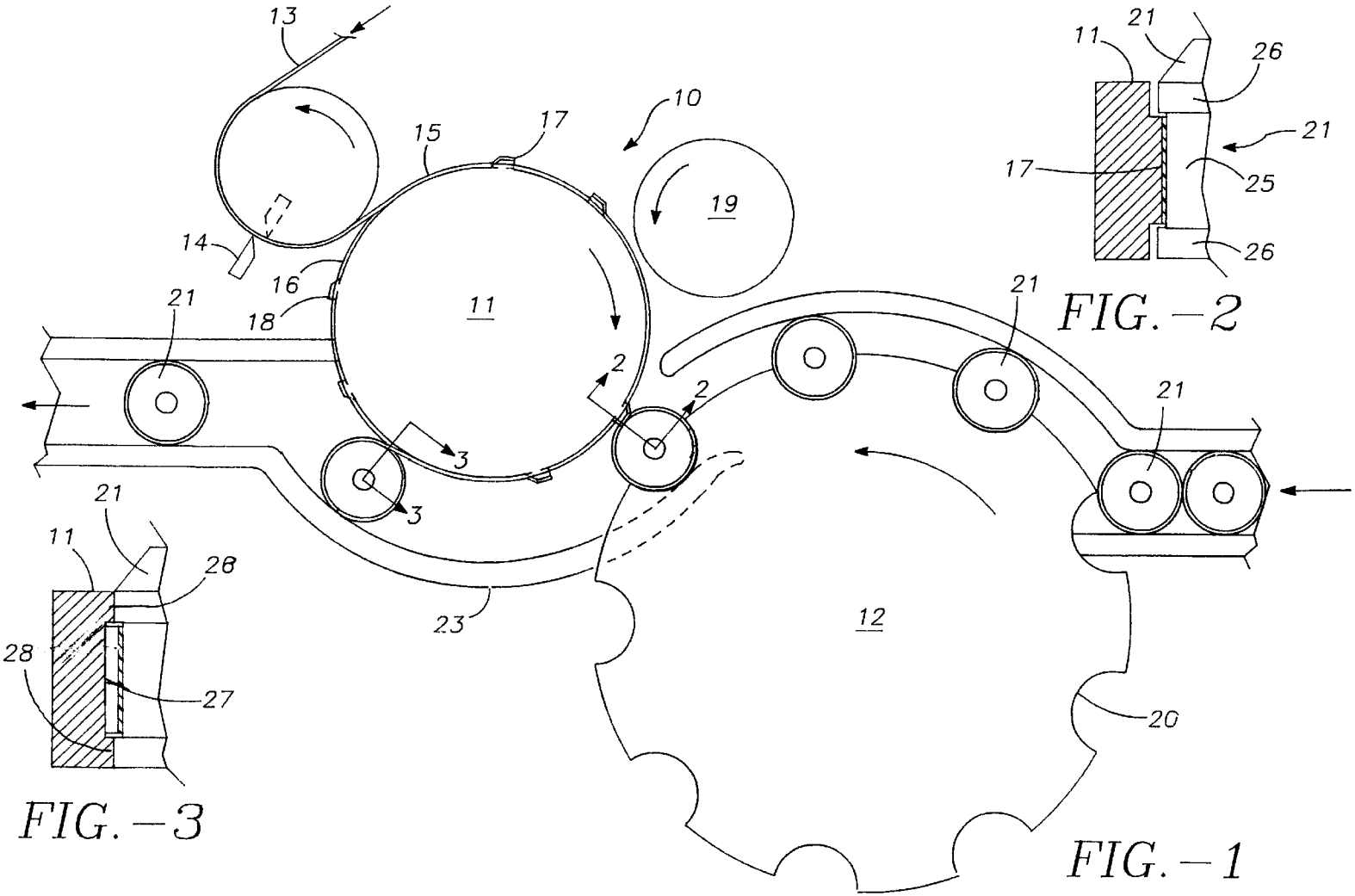
FIG. 1 is a diagrammatic view of the top of the machine of the invention.
FIG. 2 is a section taken along the line 2—2 of FIG. 1, such section being at the start of a labeling operation.
FIG. 3 is a similar section taken along the line 3—3 of FIG. 1 near but not at the end of a labeling operation.

Referring now to FIG. 1, a labeling machine is shown which is generally designated by the reference numeral 10. It is of the type described in the aforesaid U.S. Pat. No. 4,500,386. It comprises a vacuum drum 11 and star wheel type of container feed 12. Label stock 13 in the form of a roll is continuously supplied to the vacuum drum and the continuous label material is severed into individual labels by a cutter 14 which severs the label stock into individual labels, one of which is shown at 15 being applied to the surface of the vacuum drum 11.

The cylindrical surface of the vacuum drum is divided into sectors 16 to receive labels 15 and the vacuum drum is equipped with well-known vacuum means to hold the labels on its surface by vacuum and allow release of each label to a container as it is wrapped around the spinning container. At the forward or leading end of each sector 16 is a ridge 17 and at its rear or trailing end it is provided with another ridge 18. One purpose of these ridges is to forcibly hold the ends of the label against a container to which it is being applied. Also shown is a glue applicator 19 which contacts and applies adhesive to the ends of the label which are elevated by the ridges 17 and 18.

The star wheel type container feed 12 is formed with pockets 20 to hold containers 21. A curved guide 22 is used to hold the containers in the pockets 20. The star wheel 12 supplies containers to the entry point between a curved roll on pad 23 and the vacuum drum 11.

It will be understood that many parts of the machine not shown in FIG. 1 are commonly used and are well-known in the art. In U.S. Pat. No. 3,834,963 there are shown a more complete adhesive applicator system and a more complete label feed and cutting system. Normally there will be an upper star wheel 12 and a lower one to contact upper and lower parts of the container.

It will be apparent that the containers are transported between the roll on pad 23 and the sectors 16 of the vacuum drum. The labels are released from the vacuum drum 11, are wrapped around the containers and are attached to the containers by adhesive at their ends. As noted above adhesive may be applied to the container.

Referring now to FIG. 2, a container 21 is shown as having a cylindrical body portion or label panel 25 to which a label is to be applied and above and below this label panel are projecting portions 26 which are cylindrical and coaxial to the label panel 25 and of greater diameter than the label panel 25. A label is applied to the label panel 25 but not to the projecting portions 26. Also shown in FIG. 2 is a section through the leading ridge 17 of a sector 16 and which abuts the body or label portion 25 of the container. A label is squeezed between the ridge 17 and the container, thus being caused to adhere tightly to the container.

Referring now to FIG. 3, it will be seen that a recessed or inset section 27 of the vacuum drum overlies the label and that the vacuum drum is not in physical contact with the label. Above and below the label projecting portions or shoulders 28 of the vacuum drum contact the container and cause it to spin by friction directly between the vacuum drum and the container. The section 28 extends between the end portions of the label.

As the vacuum drum continues to rotate, the label wraps around the container, and as the trailing end of the label approaches the ridge 18, such ridge contacts the label and presses it against the container thus adhering the trailing end of the label to the container, or to the leading end of the label where there is an overlap.

The ridges 17 and 18 slope to the bottom of the groove 27 to avoid abrupt motion. The groove 27 extends between the lower ends of the sloping portions of the ridges 17 and 18.

The machine of this invention may employ an adhesive applicator system in which the adhesive applicator is moved inwardly and outwardly to and from a label on the vacuum drum so as to apply adhesive to the leading and trailing ends of the label. Such design will avoid the need for the use of the ridges 17 and 18. However, at the ends of the recessed portion 27 the surface of the label drum will slope upwardly from the bottom of the portion 27 to the outer circumference of the vacuum drum so that pressure is applied to the label as it initially contacts the container and again, as it leaves the container.

FIGS. 4, 5, 6, 7 and 8 illustrate different container profiles which may be labeled by the machine and by the method of the present invention.

Figure 4:
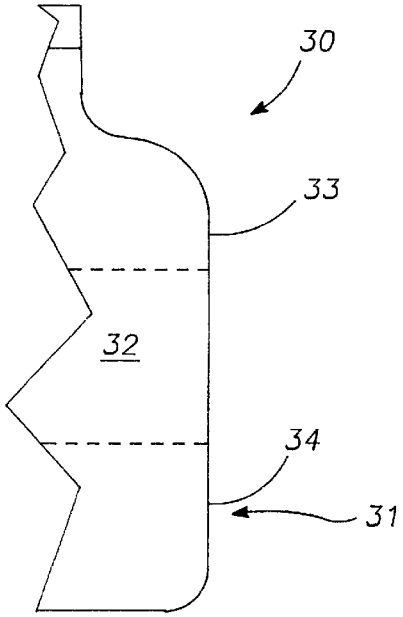
FIGS. 4 to 8 illustrate containers of different shapes which may be labeled by the machine and the method of the present invention.

FIG. 4 illustrates a container 30 having a cylindrical body 31 and label panel 32 on the body to which a label is to be applied, above and below which are sections 33 and 34, respectively, which are cylindrical and of the same diameter as the panel 32. The configuration of the vacuum drum is such that it contacts and drives the container through the label at the beginning and at the end of label application. Between the beginning and the end of label application the vacuum drum contacts the container only at section 33 and 34.

Figure 5:
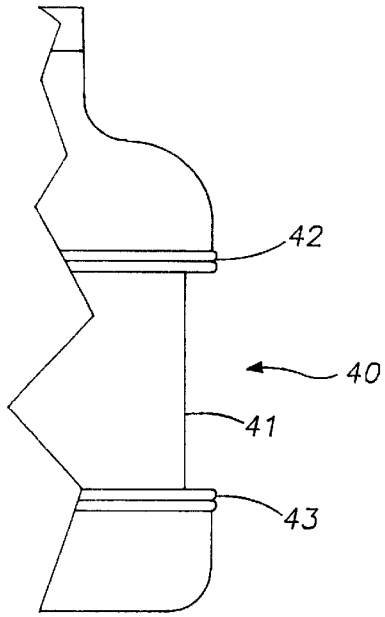

In FIG. 5 the container 40 has a label panel 41, above and below which are circular ribs 42 and 43 which have the same diameter, the diameter of the label panel being less than the diameter of the ribs. The vacuum drum is configured to contact the label on the panel 41 at the beginning and at the end of the labeling operation and to contact the ribs 42 and 43 in between.

Figure 6:
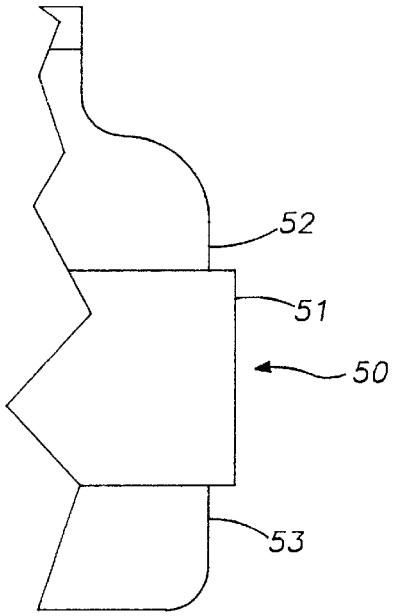

FIG. 6 illustrates a container 50 having a label panel 51 which has a greater diameter than the body portions 52 and 53 above and below label panel 51. The configuration of the vacuum drum is such that at the beginning and end of labeling it contacts the label on the panel 51 and in between it contacts only the portions 52 and 53 of the container.

Figure 7:
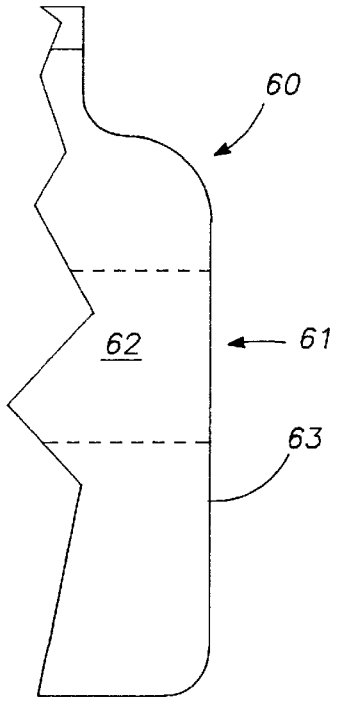

FIG. 7 shows a container 60 having a cylindrical body 61 of uniform diameter including a label panel 62 below which is a section 63 of the same diameter. The vacuum drum is configured to contact and drive the container through the label at the beginning and at the end of labeling but to drive the container through the portion 63 in between.

Figure 8:
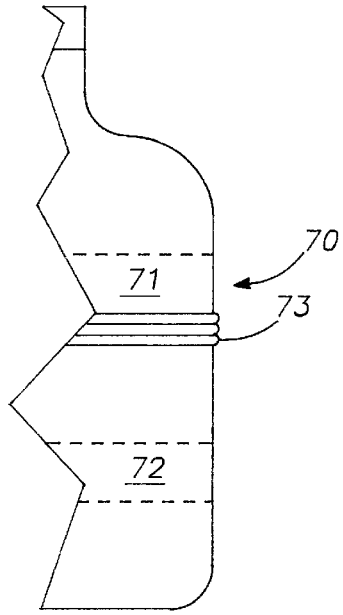

FIG. 8 shows a container 70 having two label panels 71 and 72, one being above and the other below a drive portion 73 which is in the form of ribs. The vacuum drum is configured so that it drives the container through the label on the label panels portion 71 and 72 at the beginning and at the end of labeling. In between it drives container through the ribs 73.

It will therefore be apparent that a new and useful label machine and method have been described.

We claim:

1. A method for wrapping a label about an article, said label having a leading end, a trailing end, and a segment portion between the leading end and the trailing end, said article having a designated area about which the label is wrapped, the method comprising:

holding a label to be wrapped on a surface of a rotating vacuum drum;

applying the leading edge of the held label to the designated area on the article by causing a compressive force between the vacuum drum and the article to press the leading edge onto the article;

wrapping the label about the designated area by rotating the article using direct contact between the article and the vacuum drum without allowing the vacuum drum to apply any force to the designated area on the article;

applying the trailing edge of the held label to the designated area on the article by causing a compressive force between the vacuum drum and the article to press the trailing edge onto the article; and wherein rotating the article is by direct contact between the vacuum drum and article both above and below the designated areas wherein the designated area is recessed in relation to the vacuum drum surface, and causing a compressive force comprises bringing a set of leading and trailing ridges located on the vacuum drum into contact with the label in the recessed area in the article.

2. The method of claim 1 wherein the vacuum drum surface aligned with the segment portion of the label is recessed in relation to the article surface, and causing a compressive force comprises orienting a projecting portion of the vacuum drum to align with the leading and trailing ends of the label.

3. A vacuum drum for applying segments of sheet material to articles, each segment having a leading end, a trailing end and a segment portion extending between the leading and trailing ends, said drum comprising:

a drum axis about which said drum spins, a circumferential surface parallel to said drum axis, vacuum means for holding the segments of material against said circumferential surface during rotation of said drum, said circumferential surface having spaced leading and trailing projections and a recessed section there between adapted to receive the segment portion of a segment held against said circumferential surface with the leading edge of the segment positioned on said leading projection and the trailing edge of the segment positioned on said trailing projection, said leading and trailing projections and said recessed section being configured such that said leading and trailing projections apply pressure to an article through the leading and trailing ends of the segment to bond the leading and trailing ends to the article and to spin the article about the axis of the article and move the article about said drum axis and said recessed section is spaced from the exterior of the article during transfer of the segment to the article, said circumferential surface having a drive sector adjacent said recessed section configured to apply pressure directly to the article without contacting the segment to spin the article about the axis of the article and to move the article about said drum axis.

* * * * *